United States Patent [19]

Kramer

[11] 4,289,362

[45] Sep. 15, 1981

[54] SEGMENTED DOOR FOR ENCLOSURE

[76] Inventor: Daniel E. Kramer, 2009 Woodland Dr., Yardley, Pa. 19067

[21] Appl. No.: 47,875

[22] Filed: Jun. 12, 1979

[51] Int. Cl.[3] ..... B65D 8/14; E05D 15/26; A47B 43/00

[52] U.S. Cl. ..... 312/138 R; 312/258; 312/297; 160/213

[58] Field of Search ..... 312/138 R, 138 A, 283, 312/297, 298, 258, 259; 160/213, 46, 188

[56] References Cited

U.S. PATENT DOCUMENTS

| | | | |
|---|---|---|---|
| 446,647 | 2/1891 | Rankin et al. | 312/297 |
| 469,842 | 3/1892 | Thompson | 312/297 |
| 1,217,025 | 2/1917 | Levett | 160/213 |
| 1,295,830 | 2/1919 | Lane | 160/213 |
| 1,434,705 | 11/1922 | Jeanes | 160/213 |
| 1,572,429 | 2/1926 | Grither, Jr. | 312/258 |
| 1,789,336 | 1/1931 | Johnson | 312/138 R |
| 2,909,220 | 10/1959 | Zimmerman | 160/46 |
| 3,645,596 | 2/1972 | Russell-French | 312/258 |
| 3,687,186 | 8/1972 | Paton | 160/188 |
| 3,785,695 | 1/1974 | Conkle | 160/188 |

*Primary Examiner*—Victor N. Sakran
*Attorney, Agent, or Firm*—Daniel Kramer

[57] ABSTRACT

Segmented doors for closing a wide opening in an enclosure where the upper door is hinged to the top of the opening, the lower door is hinged to the bottom of the upper door and a wire bail is provided for the purpose of locking the lower door into a V-like or triangular relationship with the upper door. This V-like structure, composed of the locked-together upper and lower doors, can then be rotated upward to a stable triangular or inverted V-like position atop the roof or top panel of the cabinet.

3 Claims, 13 Drawing Figures

SEGMENTED DOOR FOR ENCLOSURE

BACKGROUND OF THE INVENTION

1. Field of the Invention

This door construction is most related to relatively large cabinets for refrigeration systems intended to be located out of doors.

2. Description of the Prior Art

Access openings to cabinets have long been provided with vertical doors having top-edge horizontal hinges. The inventor is aware of doors with multiple panels arranged to open by folding double and then laying flat on top of the stationary horizontal roof panel. This type of construction is easy to open but it is extremely difficult to close when the cabinet is high. This is because the doors, laying flat on the top of the horizontal panel, have to be initially moved toward the closed position by exerting on them a force in the vertically upward direction. This requires the operator to provide unusual leverage or to actually be on top of the unit so that he can exert lifting force directly upward.

BRIEF SUMMARY OF THE INVENTION

Where large machinery is located outdoors, it is frequently necessary to provide cabinets or enclosures to protect the machinery from the weather. To provide maximum access to the machinery for inspection and servicing, it is desirable, and, in some cases, essential, to provide doors which close openings through which access to the machinery can be achieved. This invention is directed toward a system of doors, hinged at the top of the opening and intended to facilitate the movement of the doors to a resting place on top of the housing; and to facilitate the return of the doors to their closed position. By the use of this invention it is possible for one man to open and position on the roof, then to close doors sufficient to close an opening as large as 8×5 ft, weighing 75–90 lbs.

The invention is directed toward a vertical plane opening, closed by a series of doors whose upper and lower edges are substantially parallel to themselves and to each other, and which are hinged at their approach lines; the uppermost door being hinged to the stationary portion, which supports all the doors, and each lower door in turn being hinged to the door immediately above.

In the situation where there are only two doors, the invention is directed toward the mechanism whereby the lower door is rotated upwards until it assumes an angle of approximately 30–90° with the upper door, and at that position is latched by a wire bail or other mechanical device into that fixed angular relationship with the upper door. The two doors are then capable of and will be rotated together as a fixed, elongated, triangular object to a position where the two doors stably rest on the substantially horizontal upper partition or roof of the enclosure. The major merit of the invention lies in the ability of the operator or serviceman to return the doors to their closed position by a substantially horizontal pull. This is in contrast with the door arrangement whereby the door is allowed either singly or doubly to lie flat on the roof of the enclosure. In that case, the serviceman or operator would have to exert an upward force on the door to raise it to a near vertical position before horizontal effort could cause the door to rotate outwardly and downwardly toward the normal closed position.

Therefore, it is an object of this invention to provide a door structure capable of closing a large opening, which, with minimum effort, can be moved both to and from a fully open position where the door resides in a substantially triangular structure on top of the substantially horizontal uppermost roof structure.

DETAILED DESCRIPTION OF THE INVENTION

Figure 1:
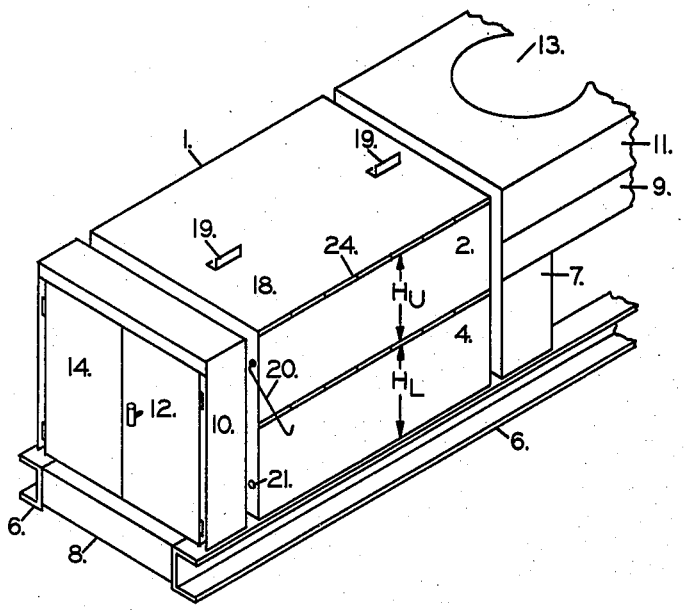
FIG. 1 shows an enclosure having closed doors of the type described by this patent.

FIG. 1 shows the compressor end of a channel-mounted refrigeration condensing unit. The control panel 10 is mounted at one end of the channel 6 and is supported additionally by cross rail 8. Access to control panel 10 is gained by doors 12 and 14, which are hinged at their outer edges. The compressor enclosure 1 has a top 18 on which cleats 19 are mounted and at least one set of horizontally-hinged side doors 2 and 4. Upper door 2 has a height $H_u$; lower door has a height $H_L$. $H_L$ can be longer then, equal to, or shorter than $H_u$. A wire bail 20 is swingably connected to upper door 2 and provided with a bent portion to engage mating hole 21 in lower door 4 under the proper circumstances, which will be further set forth.

Figure 2:
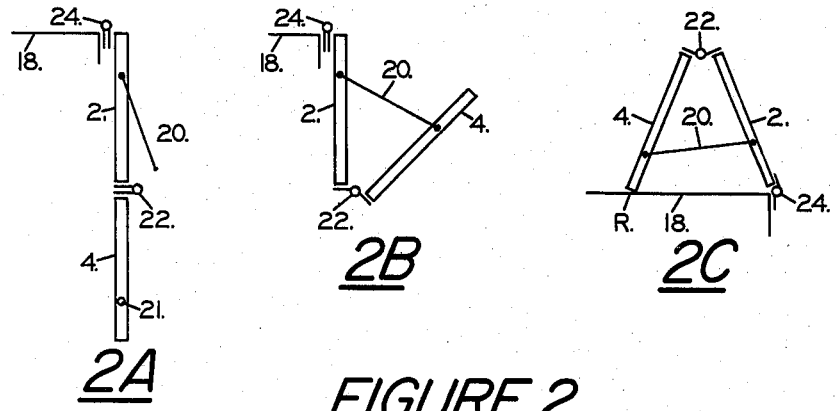
FIGS. 2A, 2B and 2C show the process by which doors having two sections are moved from the fully closed position 2A to the half open triangular structure position 2B, to the fully open position 2C, where the triangular structure is resting on top of the substantially horizontal roof structure.

FIG. 2, which has parts 2A, 2B and 2C, shows the doors 2 and 4 of FIG. 1 in end elevation, the upper door 2 with its horizontal hinge 24 providing rotatable connection to the stationary top section 18, and the lower door 4, rotatably connected by way of hinge 22 to the lower edge of the upper door 2. When the lower door 4 is rotated through an angle of about 120° (2.1 radian), the wire bail 20 can be rotated about its pivot point in the edge of door 2 so its bent end can enter and engage with hole 21 in the edge of lower door 4. When the doors 2 and 4 are very long, a second bail, 20' (not shown) similarly located at the other end of the door 2, may be used to engage a similiar hole 21' (not shown) and thereby lock the upper and lower doors into a relatively rigid triangular or V-like structure. This V-like structure, shown in FIG. 2B, can then be rotated to a stable position on top of the upper panel 18, as shown in FIG. 2C. From its rest position of FIG. 2C a horizontal pull on upper door 2, easy to impose by an operator standing in front of the opening, is sufficient to begin the rotation of the triangular structure composed of the doors 2 and 4 and bail 20 into the partially closed position of FIG. 2B. Had the wire bail not been used, the two doors would have fallen to a position flat upon roof panel 18; then, only an upward force on the doors could have begun the closing process. By contrast, the doors at rest in the position shown in 2C can be started toward their closed position by a horizontal force which is substantially more convenient to exert, especially when the height of the roof panel 18, above the working surface, is large, for instance, 60" (1.5 meters), a normal height for such a construction.

The horizontal force required to start the doors from the position of FIG. 2C toward the closed position could be substantially reduced if bail 20 were shortened, so that in the rest position of FIG. 2C, the point R, at which door 4 contacts panel 18, is closer to hinge 24.

Figure 3:
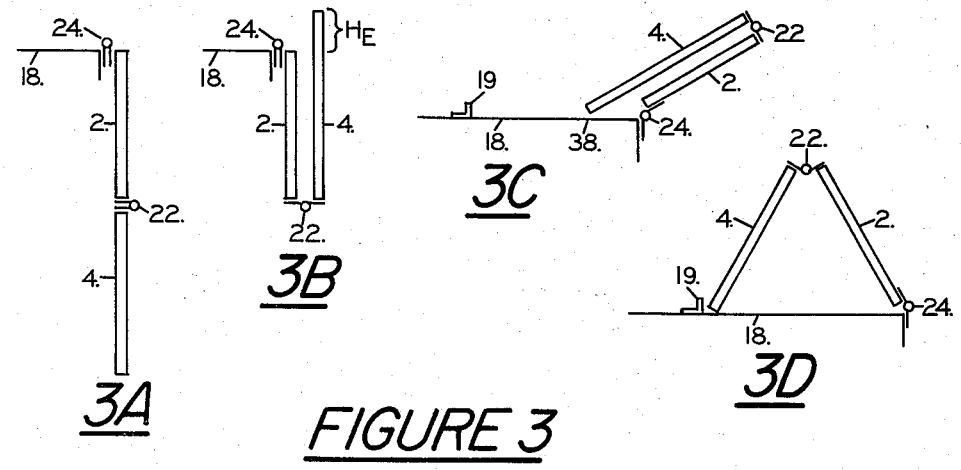
FIG. 3 shows doors having unequal height with the higher door being lowest so arranged that on rotation to a position on top of the roof structure a triangular, self-supporting, stable position is automatically secured.

FIG. 3 has four parts: 3A, 3B, 3C and 3D. 3A shows two doors, similar to that of 2A, except that the height $H_L$ of the lower door 4 is significantly greater than the height $H_u$ of the upper door 2. This difference is shown in FIG. 3B when the lower door is rotated by the operator to a position parallel to and adjacent the upper door 2. The excess of the height $H_L$ of the lower door 4 over the height $H_u$ of the upper door 2 is shown visually by the projection of the lower door 4 above the upper edge of upper door 2. This excess height is labeled $H_e$ in FIG. 3B.

The process of moving the doors 2 and 4 from their closed position of FIG. 3A to their fully open at-rest position of FIG. 3D is as follows: lower door 4 is first rotated to a fully vertical position adjacent to upper door 2 as shown in FIG. 3B. The pair of doors is then rotated toward a vertical upright position, during which rotation the lowermost protruding portion of lower door 4 contacts the roof panel 18 at point 3B. Continued rotation of the doors causes the lowermost portion of door 4 to slide toward stop 19, which is firmly attached to roof panel 18. When the lowermost edge of door 4 has come to rest against stop 19, doors 2 and 4 are in a stable position on top of the roof panel 18 because the center of gravity of both doors, which is at their horizontal mid-point, lays over the roof panel. A latch, not shown, is provided to secure the lower edge of door 4 to stop 19 to prevent gusts of wind from unexpectedly blowing the doors toward the closed position.

Figure 4:
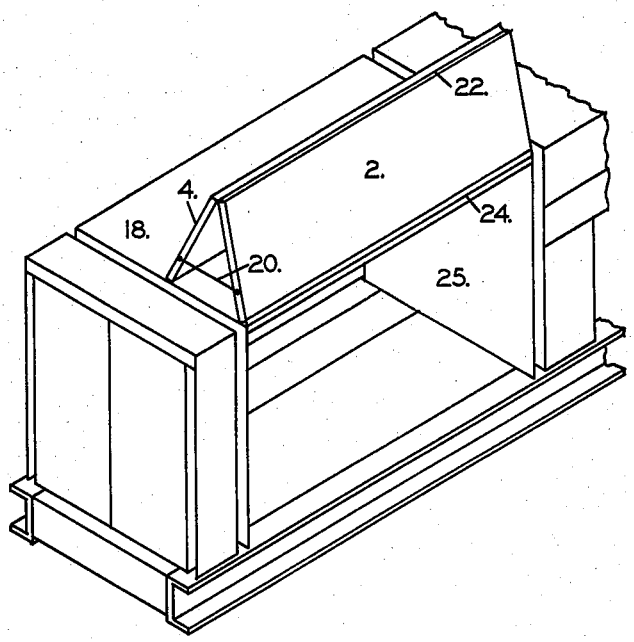
FIG. 4 shows the structure of FIG. 1 with its doors in the open position.
Figure 5:
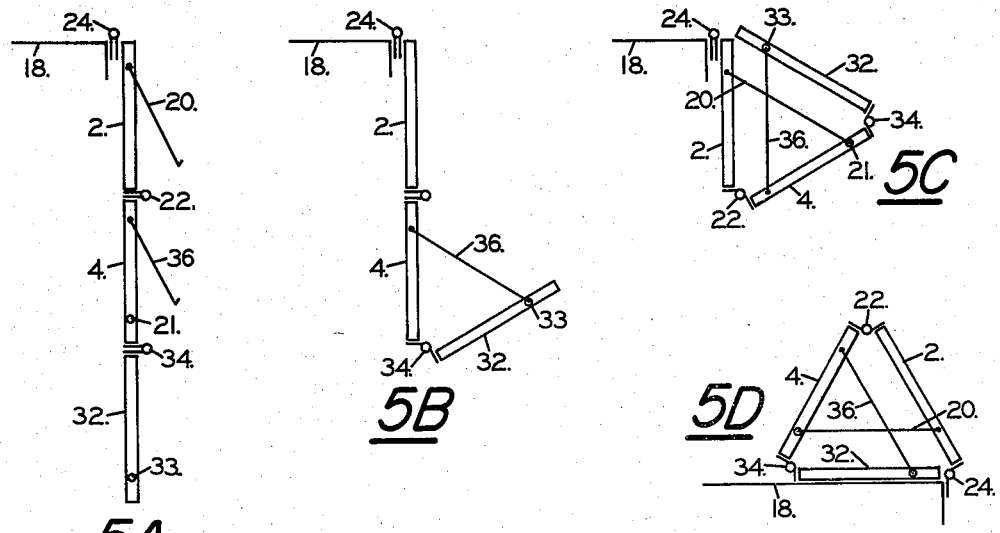
FIG. 5A shows a 3-door assembly in the closed position.
FIG. 5B shows the lower door rotated to and locked in a triangular configuration with the intermediate door.
FIG. 5C shows the two lower doors rotated to and locked into a triangular configuration with the uppermost door.
FIG. 5D shows the three door assembly rotated into a rest position on top of the substantially horizontal roof structure.

When the user desires to close the doors, it is only necessary for him to grasp upper door panel 2 and pull it towards him, which causes the lower edge of door 4 to slide along roof panel 18 until the position of the doors of FIG. 3C is reached, at which time the pair of doors is lowered to the position of 3B and the upper door is rotated to its rest position, shown in FIG. 3A. FIG. 4 shows the construction of FIG. 1 with the doors on one side of the cabinet in their fully-open at-rest position, leaving opening 25 substantially adjacent top 18. The steps by which the doors of the cabinet FIG. 4 are raised to their full open position is illustrated by the stepwise process shown in FIGS. 2A, 2B and 2C, already described.

Where the space available for raising the doors is limited or where the doors are of heavy material, the doors may be divided into more than two panels, as shown in FIG. 5, which has four parts: 5A, 5B, 5C and 5D. In FIG. 5A the doors are at their rest position, closing the opening of the housing. In 5B, lower door 32 has been raised to a position such that it forms an acute angle with its adjacent door 4. It is latched into position by strut 36 which is hingedly engaged to the upper edge of door 4 and capable of engagement with hole 33 of lower door 32. In FIG. 5C the triangular assembly, composed of doors 4 and 32 and strut 6 has been rotated so that door 4 resides in an acute angular relationship with upper door 2. Door 4 is held in this angular relationship with upper door 2 by strut 20 which is hingedly mounted to upper door 2 and connected to intermediate door 4 by having its projection inserted in the hole 21 of door 4. The substantially rigid triangular structure, comprised of the 3 doors and the 2 struts, as shown in FIG. 5C, can then be rotated to its resting position on top of roof panel 18, as shown in FIG. 5D. The lowering of the doors from the fully open position of 5D to a fully closed position of 5A is achieved by simply reversing the steps as shown in sequence FIGS. 5D, 5C, 5B and finally 5A.

I claim:

1. A cabinet having a top, a side and an edge common to the top and side; an opening in the side; upper door means having height $H_u$ for opening and closing an upper portion of the opening, said door means having an upper and a lower edge and having a closed and open condition; first hinge means for allowing the upper door to rotate about a line parallel to and substantially adjacent said common edge; lower door means having a height $H_L$ for opening and closing a lower portion of the opening, said door means having an upper and lower edge and having a closed and open condition; second hinge means connecting the upper and lower door means for allowing the lower door to rotate up and outwardly from its closed condition, said rotation occurring about a line parallel to and substantially adjacent the lower edge of the upper door; and means for providing access to said opening by positively positioning the doors in an inverted Vee relationship on said top.

2. A cabinet as in claim 1 where the means for positively positioning the doors includes means for locking the lower door into an upright Vee relationship with the upper door while the upper door is in its closed condition.

3. A cabinet as in claim 1 where the means for positively positioning the doors includes construction where the door height $H_1$ exceeds door height $H_u$.

* * * * *